United States Patent [19]

Malinowski

[11] 4,420,746

[45] Dec. 13, 1983

[54] SELF-CALIBRATING SMOKE DETECTOR AND METHOD

[76] Inventor: William J. Malinowski, Johnson St., P.O. Box 274, Bryantville, Mass. 02327

[21] Appl. No.: 246,960

[22] Filed: Mar. 24, 1981

Related U.S. Application Data

[63] Continuation-in-part of Ser. No. 61,186, Jul. 27, 1979, Pat. No. 4,266,220.

[51] Int. Cl.[3] ..... G08B 17/10

[52] U.S. Cl. ..... 340/630; 250/574; 340/501; 340/629

[58] Field of Search ..... 340/630, 629, 628, 527, 340/501; 250/573, 574; 356/438, 439, 431, 338, 339

[56] References Cited

U.S. PATENT DOCUMENTS

| | | | |
|---|---|---|---|
| 4,021,792 | 5/1977 | Ludt et al. | 340/630 |
| 4,237,453 | 12/1980 | Malinowski | 340/630 |
| 4,249,169 | 2/1981 | Malinowski | 340/630 |
| 4,254,414 | 3/1981 | Street et al. | 340/627 |
| 4,266,218 | 5/1981 | Kardash | 340/628 |
| 4,266,220 | 5/1981 | Malinowski | 340/630 |

*Primary Examiner*—John W. Caldwell, Sr.
*Assistant Examiner*—Daniel Myer
*Attorney, Agent, or Firm*—Morse, Altman, Oates & Dacey

[57] ABSTRACT

A self-calibrating obscuration smoke detector is provided along with a method for the operation thereof. A light source and a photodetector are mounted in spaced relation to one another with the output of the photodetector being a function of the amount of light sensed by the detector from the light source. The photodetector analog output is converted into digital signals by an A/D converter and digital signals are then delivered to a digital processor adapted to periodically calibrate the detector and to perform sampling operations between calibrations. Other sensing devices may be connected to the system with automatic self-calibrating capabilities with respect thereto including a temperature responsive element the output of which may be used to compensate for changes in ambient temperature. By using a pair of photodetecting cells directly visible to separate light sources or indirectly visible to a single source, a thermally stable system is provided where one cell provides a reference output for the other cell.

8 Claims, 14 Drawing Figures

SELF-CALIBRATING SMOKE DETECTOR AND METHOD

CROSS-REFERENCE TO RELATED APPLICATION

This is a continuation-in-part of application Ser. No. 061,186, filed July 27, 1979, now U.S. Pat. No. 4,266,220.

BACKGROUND OF THE INVENTION

1. Field of the Invention

This invention relates generally to obscuration smoke detectors and more particularly is directed towards a new and improved obscuration smoke detector and method for the operation thereof in which automatic self-calibration functions are performed on a regular basis.

2. Description of the Prior Art

When smoke detectors are tested, one of the techniques used to determine the sensitivity of the unit is to place a photodetector at a distance from the light source, i.e. 5 ft. in the case of Underwriters Laboratory. The sensitivity of the detector is then measured in terms of obscuration per foot with typical values ranging from 0.2% to 4% per foot. Although such a device has good short term stability, it has poor long term stability and requires calibration prior to each test. Further, it is affected by temperature changes, and by dirt or film build-up on the optical surfaces of the components which cause transmission changes greater than would be caused by smoke alone.

Accordingly, it is an object of the present invention to provide improvements in smoke detectors and the method of operation thereof. Another object of this invention is to provide a thermally stable, self-calibrating, obscuration smoke detector and method of operating said detector.

SUMMARY OF THE INVENTION

This invention features a self-calibrating smoke detector, comprising a light source and a photodetector mounted in spaced relation to one another with the detector adapted to produce an analog electrical output which is a function of the amount of light sensed by the detector from the light source. An analog-to-digital converter is connected to the detector and is adapted to produce digital signals corresponding to the analog output of the detector. A digital processor is connected to the A/D converter and includes memory means and signal processing means adapted to recalibrate the detector periodically and to perform smoke sampling tests between each recalibration. Additional sensing elements such as heat sensors may also be connected to the system and be recalibrated periodically on an automatic basis to provide heat alarm functions as well as to provide a thermal reference for stabilizing optical functions.

In a modification of the invention a pair of photodetectors is provided, one visible to a light source which may be obscured by smoke and another visible to a second source or to the first source through an attenuator to form a temperature stable system.

This invention also features the method of operating an obscuration type smoke detector having a light source and a photodetector wherein the analog output of said detector is first converted into digital signals which are periodically compared with a previous output stored in memory as a reference level and to correct the reference level as required for automatic calibration of the system. Each new reference level after automatic recalibration is used as the reference for sampling operations to determine the presence or absence of smoke. Temperature information is also utilized to provide compensation for thermal effects in the operation of optical components.

DETAILED DESCRIPTION OF THE PREFERRED EMBODIMENTS

Figure 1:
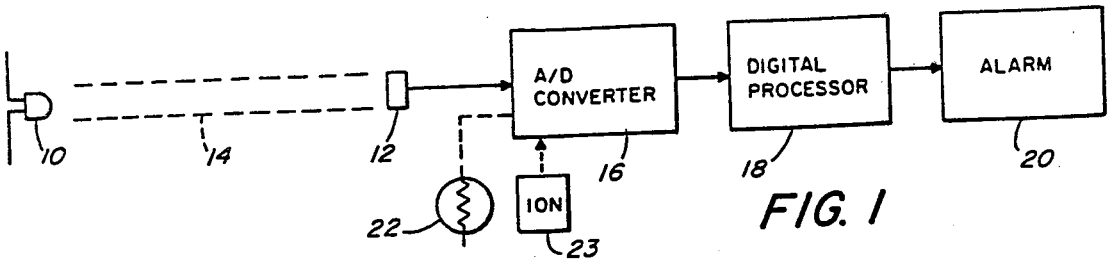
FIG. 1 is a simple schematic block diagram of a self-calibrating smoke detector made according to the invention.

Referring now to the drawings and to FIG. 1 in particular, there is illustrated, in simple block diagram, an obscuration type smoke detector with automatic self-calibrating capabilities. The system will automatically and periodically compensate for any change in its own operating characteristics except those due to the presence of smoke. In FIG. 1 the reference characteristic 10 generally indicates a light source, such as a LED, mounted in a spaced relation to photo-responsive means such as a photodetector 12 and in position to shine a light beam 14 against the detector 12. In the customary embodiment of a smoke detector, air is allowed to pass between the light source 10 and the photodetector 12 so that any smoke present in the air will be carried through the light beam 14, attenuating the beam and causing the smoke detection system to be actuated when the smoke density reaches a predetermind level.

The photodetector 12 may be any one of a variety of different photo-responsive devices and, in practice, it has been found that a photodetector utilizing a cell of cadmium sulfide having a peak output of 6150 A provides satisfactory results. This material offers an intermediate overall spectral response with good temperature and resistance characteristics. The photodetector 12 is an analog device adapted to produce an electrical output corresponding to the amount of light detected from the light source 10. Thus, during normal operation under steady state conditions of temperature and no smoke present, the output of the detector will be stable over the short term. Any smoke that may pass through the beam 14 will, of course, reduce the amount of light falling against the detector and its electrical output will be reduced in turn.

Over the long term, a system of the above type tends to be unstable due to factors such as the accumulation of dirt, film, dust etc. on the optical face of the device 12 and changes in the electrical characteristics of the device due to age, temperature, and the like. As a result, the electrical output of the device typically is reduced over a long period of time. In the present invention changes in the operating characteristics of the system are corrected by recalibrating the system automatically on a regular, periodic basis.

As shown in FIG. 1 the output of the photodetector 12 is fed to an analog-to-digital converter 16 adapted to convert the analog signals from the photodetector into digital signals. From the A/D converter the digital signals are fed into a digital processor 18 which may be a full computer, a fixed logic array, or microprocessor, for example. The function of the digital processor 18 is to recalibrate the detector at discrete intervals as well as to perform smoke sampling operations between each calibration. The digital processor is connected to an alarm 20 which is actuated in the event that the smoke density between the light source 10 and the detector 12 exceeds a predetermined value, as periodically adjusted by the calibration operation.

A typical period between each calibration performed by the digital processor 18 could be set at ten minutes with smoke sampling procedures taken every five seconds. Thus, the alarm level will be adjusted every 10 minutes to compensate for any changes in the operating characteristics of the system and the sampling of atmosphere for the presence of smoke or other aerosols will be performed on a more frequency basis between each calibration to ensure that the presence of smoke will be promptly detected and the alarm actuated.

In addition to its primary function as an optical smoke detector such as illustrated, the system could also be used to monitor temperature by providing a temperature sensing device such as a thermistor 22 connected to the A/D converter 16. The output of the thermistor 22 provides an analog input to the converter 16 which, in turn, delivers digital signals appropriate for handling in the digital processor 18. The output of the thermistor thus may be used to actuate the alarm 20 when a rate of change in temperature or a fixed reference temperature has been exceeded. The signal could also be used by the processor to determine if the unit should recalibrate itself. The system may also be used with an ionization type smoke detector 23 shown in box form in FIG. 1 and more fully in the FIG. 13. If the optical components of the smoke detector function in a predictable manner thermally, and if the ambient temperature at the detector is known, then the short term reference can be modified to compensate for the effect of the change in output of the optical components which would be expected from the change in temperature. Thus, a thermally stable system is provided using only one light source (LED) and one photo detector that may be thermally unstable since their instability effects can be calculated out. Long term changes would be handled as before.

In addition to providing automatic calibration operation on the system, the digital processor may also be utilized to discriminate between low level build-up of smoke such as commonly occurs from a group of smokers, and a real hazard where the smoke emanates from a fire.

Figure 2:
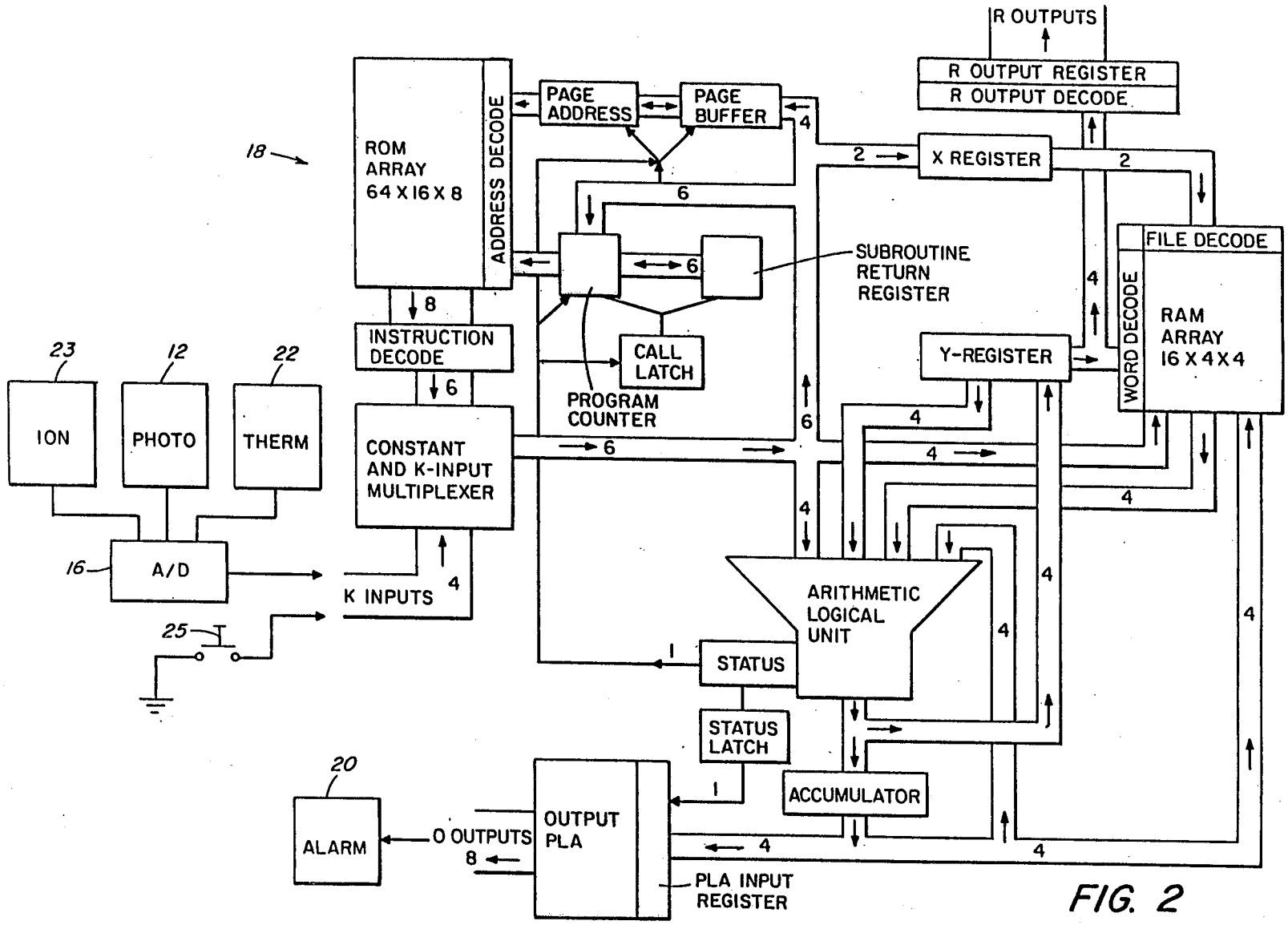
FIG. 2 is a view similar to FIG. 1 but showing greater detail with respect to the functional components of the FIG. 1 processor.

While the digital processor 18 may be a full computer or a fixed logic array, the invention, in the preferred embodiment, utilizes a microcomputer such as single chip microcomputer available from Motorola for example. One such microprocessor preferred for use in the present invention is 4-bit CMOS microcomputer available from Motorola Semiconductor Products, Inc. and identified as the MC141000 family. A functional block diagram of the micrcomputer is illustrated in FIG. 2. The unit is characterized by low power requirements operating in the range of 3 to 6.5 volts and from 0.36 to 11.5 mW.

Inputs to the processor 18 are from the A/D converter 16, which, if connected to several sensing devices as shown in FIG. 2 may be multiplexed. For this purpose an MC144447 may be used.

An optional input to the processor may be a manually operated pushbutton 25 which connects to an input terminal and to ground. The function of the pushbutton 25 is to permit forced recalibration of the system. Such a capability is advantageous in circumstances where the alarm is actuated as the result of non-dangerous conditions of a transient nature, for example, excessive smoke from cooking, lighting a fire in a fire place, or the like. If the alarm is actuated under such conditions, the system can be recalibrated by pushing the button 25 causing a new reference level to be set in the system. This will turn off the alarm and, as the temporary smoke clears, the system will automatically recalibrate itself to existing conditions.

Figure 14:
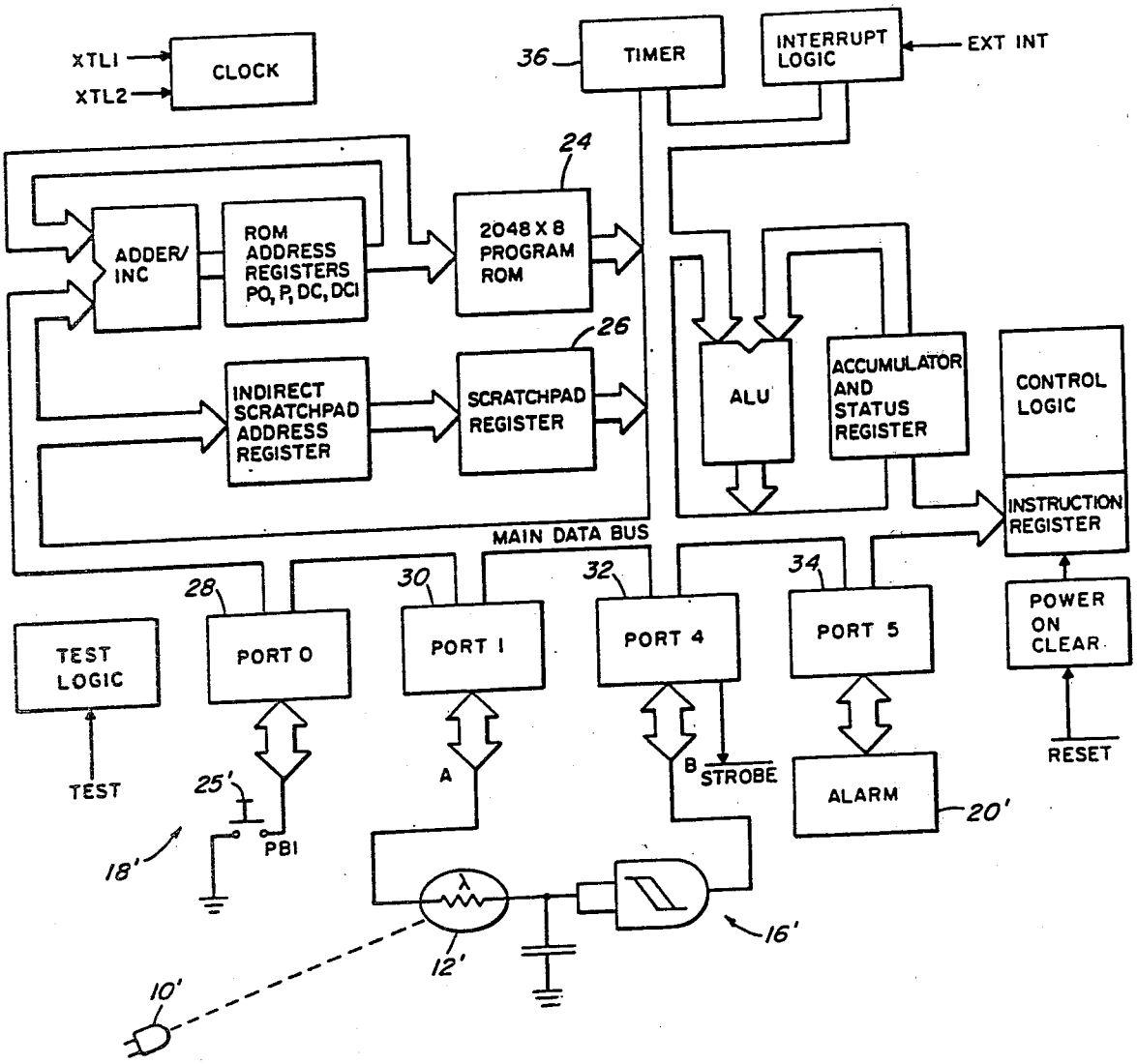

Another such microprocessor is the Motorola single chip NMOS microcontroller MC3870 illustrated in FIG. 14. Such microprocessors involve large scale integrated circuits on a single chip which provide considerable flexibility in design and functional operation of the circuit at low cost and in compact form. The processor 18' of FIG. 14 is an 8-bit microcomputer utilizing ion-implanted, N-channel silicon-gate technology and includes a 2048-byte mask-programmable read only memory 24 and a 64-byte scratchpad random access memory 26, with the four input-output ports 28, 30, 32 and 34. In practice two of the ports such as 28 and 30 are connected to the A/D converter 16'. The processor also includes a programmable binary timer 36 having three operating modes, namely, an interval timer mode, a pulse width measurement mode and an event counter mode. The time base for the unit may be by means of a crystal, LC or RC circuit and may be external or internal. The system functions on low power, typical power requirements being on the order of 275 mW using a single 5-volt±10% power supply.

Various types of A/D converters may be used to convert the analog output of the photodetector to digital signals which can be handled by the digital processor 18. For example, FIGS. 3 through 10 show several different A/D converters which may be used for this purpose along with the typical wave forms generated by the converters. The FIG. 3 converter is comprised of a hysteresis gate 40 across which is connected a photoresistive type of a photodetector 42 connected on one side to ground through a capacitor 44 with the output connected to a port of the digital processor 18. Light falling on a photoresistive device 42 will control the frequency of the circuit generating a train of digital pulses such as shown in FIG. 4.

Figure 3:
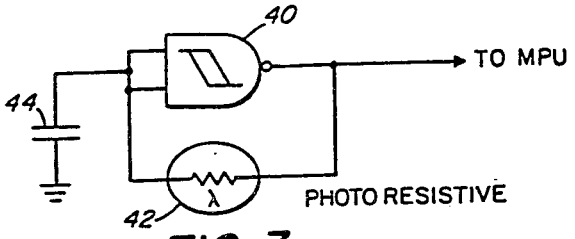
FIG. 3 is a circuit diagram of an A/D converter that may be used with the detector.
Figure 4:
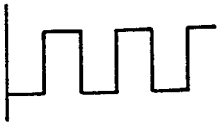
FIG. 4 is a wave-form diagram showing the characteristic output of FIG. 3 circuit.
Figure 5:
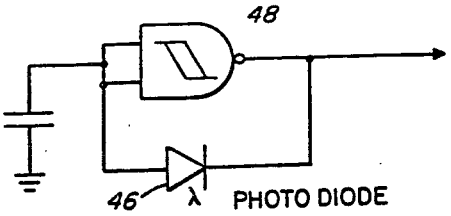
FIG. 5 is a circuit diagram showing a modified A/D converter.
Figure 6:
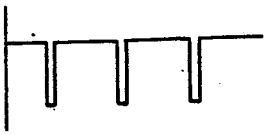
FIG. 6 is a wave-form diagram showing the output of the FIG. 5 circuit.

The FIG. 5 converter is similar to that of the FIG. 3 circuit with the exception that instead of the photoresistive device 42 a photo diode 46 is connected across a hysteresis gate 48 generating pulse shapes of the sort shown in FIG. 6.

Figure 7:
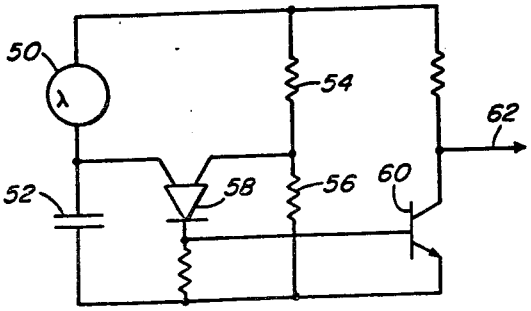
FIG. 7 is a circuit diagram showing yet another modification of the A/D converter.
Figure 8:
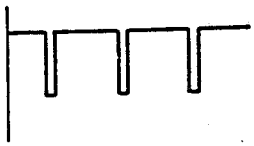
FIG. 8 is a wave-form diagram showing the output of the FIG. 7 circuit.

In the FIG. 7 circuit any type of photodetecting device 50 is connected in series to a capacitor 52, both in parallel to a pair of series connected resistors 54 and 56. Between the resistors and the photodetector 50 there is connected a diode device 58 the output of which controls the base of a transistor 60, which in turn results through a lead 62 in a series of output pulses of the sort shown in FIG. 8.

Figure 9:
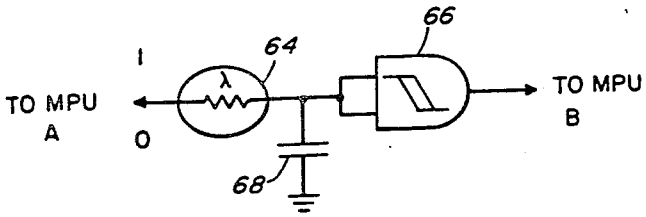
FIG. 9 is a circuit diagram showing yet another A/D converter.
Figure 10:
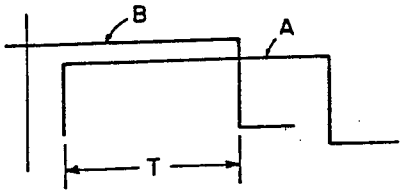
FIG. 10 is a wave-form diagram showing the output of the FIG. 9 circuit.

In the FIG. 9 converter, a photoresistive cell 64 is connected on one side to a hysteresis device 66 and on the other side is connected to the digital processor. The hysteresis device 66 connects to another port of the processor and a capacitor 68 is connected between the junction of the two devices and ground. The circuit generates a series of output pulses that overlap as suggested in FIG. 10, each overlap being measured by the digital processor and represented by T in FIG. 10.

In practice, the digital processor is programmed to make smoke sampling measurements of the photodetector output on a frequent basis and, less frequently, to calibrate the system. On a smoke sampling basis, the digital output of the A/D converter, which is a function of the output of the photodetector, is compared with a reference which has been placed in a memory of the processor during a previous calibration operation. Typical calibration operations might be performed on the order of perhaps every 10 minutes but smoke sampling operations might be performed every 5 seconds. If during a calibration operation the output of the A/D converter is 3,000 pulses, for example, the data is placed in the memory portion of the processor and the previous reference data is eliminated. During the intervening frequent smoke sampling operations, the output of the photodetector, which is converted to digital pulses, is compared to the reference data in the memory. Assuming there is no difference between the data in the memory and the data from the sampling operation no alarm will be generated. However, if sampling data is below the reference by a predetermined amount the processor will cause the alarm 20 to be actuated. The reduced digital output of the converter represents a reduced output of the photodetector arising from the presence of smoke between the light source and the photodetector. Assuming normal operation between each calibration cycle of the system, the processor will again automatically replace the old reference in the memory with a new reference for use in the next series of smoke sampling operations. Thus, any change in the long term operating characteristics of the detector are compensated for through periodic, automatic calibration of the system so that each smoke measurement will be made against a recent, valid reference base. Accumulation of dust, dirt or film for example, on the optical faces of the detector over a period of time or a change in the sensitivity thereof arising out of changing temperature or other factors will be automatically corrected by the automatic periodic calibration of the system by the digital processor.

The processor not only is self-calibrating it can also generate a warning signal in the event that the detector for some reason is unable to calibrate itself. Such a condition might exist, for example, if one of the components of the system has degraded beyond a useful level, if excessive film has accumulated on the face of an optical element or if there has been a catastrophic failure of a component. A smoke detector of the type disclosed using a microprocessor is quite simple and extremely compact and eliminates the need for any complex design in the smoke chamber. The detector displays only a minimal change in response to different colored smoke such as gray to black variations. The detection level is a function of programming and can be made an external function of the detector. The system detector would only need the light source, the sensor and processor. The processor unit itself can be located remote from other portions of the detector and can also be made to control a large number of units rather than just a single unit as shown. This can readily be done by multiplexing techniques known in the art. Insofar as the same method of detection would be used to check out the operation, the system is highly predictable. The recalibration of the system need not necessarily involve a total sum at the end of each calibration cycle. For example, the data may involve some digital increment of a lump sum so as to compensate for a slow change in conditions. Also, data handling operations need not be simple counting operations to quantify operational data insofar as other quantifying procedures such as successive approximations may also be used to advantage.

Figure 11:
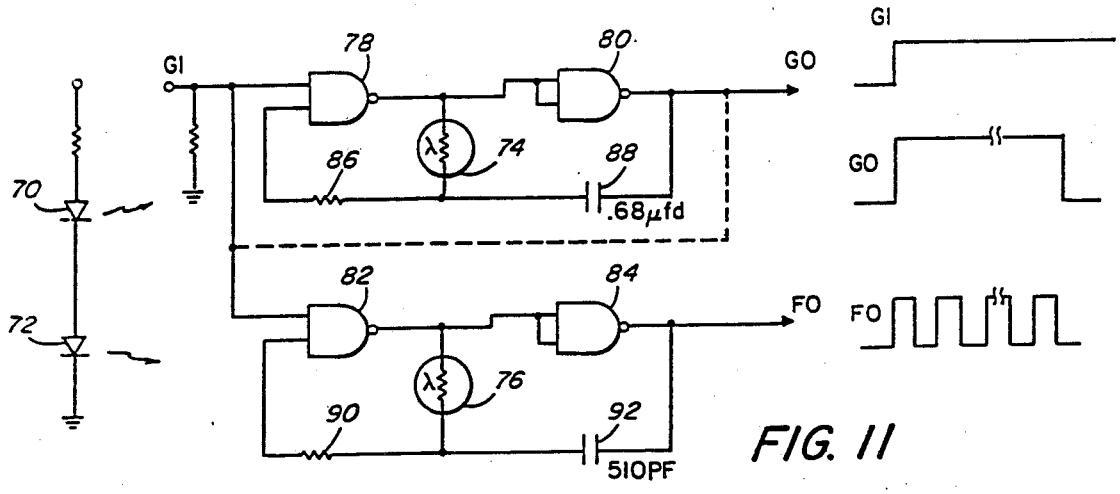
FIG. 11 is a circuit diagram showing a dual cell modification of the invention.

Referring now to FIG. 11, there is illustrated a modification of the invention, and, in this embodiment means are provided to ensure stability of operation despite changes in ambient temperature and/or line voltage. The FIG. 11 system utilizes two light sources 70 and 72, preferably LEDs, connected in series and adapted to illuminate cells 74 and 76, respectively. Each cell is part of an oscillating unit comprised of gates 78 and 80 in the upper circuit and gates 82 and 84 in the lower circuit. Also included are a resistor 86 and a capacitor 88 in the upper circuit and a resistor 90 and a capacitor 92 in the lower circuit. The waveform of each oscillator section is illustrated near the outputs thereof. In practice, the capacitance of C1 should be substantially greater than that of C2 and in the illustrated embodiment the ratio is in excess of 1000 to 1.

The circuit operates in the following manner. When a 1 signal is applied to the input terminal G1 it will cause the output to go to a 1 state. This change of state can be used to gate an oscillator on or to signal a counter that the oscillator has been started and to total the input information until the G signal goes to a 0 state. Since the LEDs 70 and 72 are connected in series and being in the same environment any change in ambient thermal conditions and/or in supply voltage will affect equally both LEDs and both cells 74 and 76 are operated at the same impedance level. In practice, air, which may or may not contain smoke or other aerosol, is allowed to pass between LED 72 and the cell 76 while the light path between LED 70 and the cell 74 is not subject to interruption by smoke.

Insofar as the capacitor 88 is of much greater capacitance that the capacitor 92, the number of events that occur at the output F0 of the lower ciccuit as compared to the output G0 of the upper circuit will be established by the ratio between the two capacitors. As already indicated, a typical example of the ratio is 1000 to 1.

Since any variation in ambient temperature and/or voltage supply will affect both cells, the same amount of pulses at F0 will occur. If smoke is present, the amount of pulses at F0 will decrease. The digital processor connected to the FIG. 11 circuit will sample these pulses and compare them against a reference, which reference is periodically updated. The regular and automatic updating or recalibration procedure by the processor cancels degradation within reasonable limits of components in the system and any remaining voltage supply or temperature variation as well as loss of signal strength through dirt build-up on the faces of the optical elements.

Figure 12:
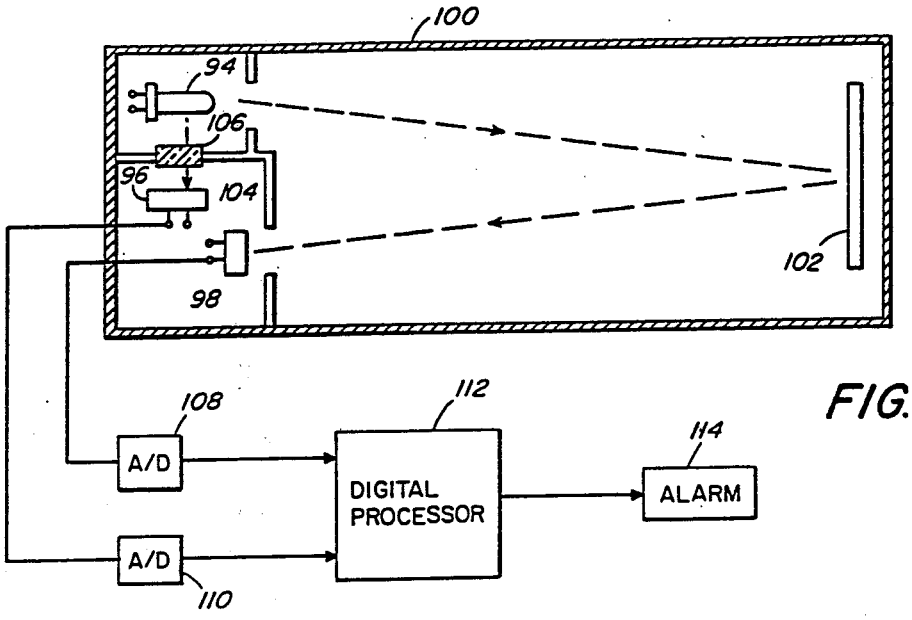
FIG. 12 is a schematic plan view showing a modified dual cell arrangement.

Referring now to FIG. 12 of the drawings, there is illustrated a further modification of the invention and, in this embodiment, there is provided a temperature and voltage compensated smoke detector similar to that of the FIG. 11 embodiment but requiring only a single light source instead of two light sources. In FIG. 12 a single light source such as an LED 94 illuminates a pair of cells 96 and 98, all mounted in a common housing 100. The LED 94 is mounted at one end of the housing and is directed towards a mirror 102 at the opposite end. The mirror serves to fold the light path from the LED 94 to the cell 98 which is also directed at the mirror. The cells are separated from the light source by a wall 104 in which is mounted an optical attenuator 106 in line with the cell 96. The function of the optical attenuator 106 is to reduce the light from the LED 94 so that the impedance of cell 96 is similar to that of the cell 98.

Each cell is connected to an A/D converter 108, and 110 respectively which, in turn, connect to a digital processor 112. The processor 112 has an output to an alarm 114, as in the principal embodiment.

A smoke detector of the above sort provides a long beam length in a small volume and thereby produces a greater signal change in the event of smoke passing through the chamber. The system will remain in balance despite thermal or line voltage changes. In operation, each sampling operation will cause a gate to open to let through the processor a burst of pulses which will be counted and compared to the most recent reference in the manner already described above.

As a preferred embodiment of the A/D converters shown in FIG. 11, a better operating match can be achieved by using capacitors of the same or approximately the same capacitance, such as 510 PF, for example. In such an arrangement the light falling on the cell 74 would be mechanically adjusted by known means to about the same level as the light falling on cell 76. In such case, $F1 \approx F2$. The digital processor would then total F1 and F2 and, after a fixed amount of F1s, F2 would be compared. This arrangement provides greater flexibility than using a capacitor to generate a gate signal, since the gate will be a function of software. Furthermore, the thermal match would be improved since cell $1 \approx$ cell 2, $C1 \approx C2$ and oscillator $1 \approx$ oscillator 2. The resolution of the measurement would be at the control of the programmer and simpler oscillator circuits may be employed. If desired, the oscillator functions can be incorporated in the processor itself.

Figure 13:
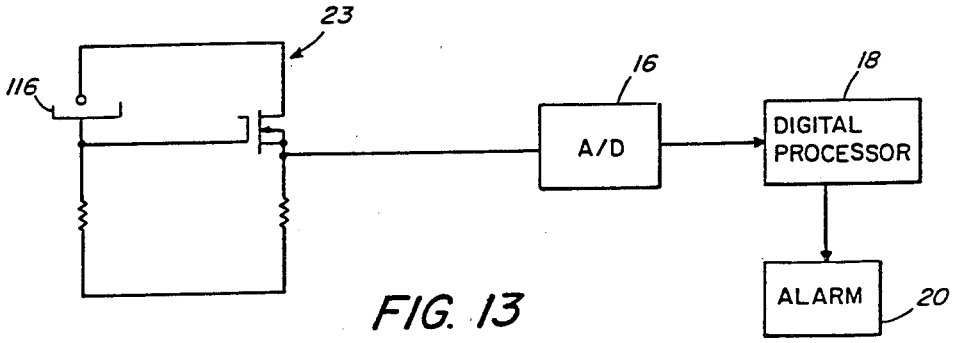
FIG. 13 is a schematic diagram of an ionization type smoke detector that may be used in the invention, and, FIG. 14 is a view similar to FIG. 2 but showing a modification thereof.

Referring now to FIG. 13 there is illustrated a circuit for use in detecting smoke by ionization techniques. The circuit includes an ionization chamber 116 and an FET insulated gate 118 providing an output to the A/D converter 16. If smoke passes into the ionization chamber the voltage output of the device will drop and will cause the alarm to be actuated if the drop exceeds a predetermined value.

While the invention has been described with particular reference to the illustrated embodiments, numerous modifications thereto will appear to those skilled in the art.

Having thus described the invention, what I claim and desire to obtain by Letters Patent of the United States is:

1 The method of detecting an aerosol such as smoke in a gaseous medium, comprising the steps of (a) directing at least one beam of light through said medium, (b) converting the light energy of said beam after passing through said medium to analog electrical signals, (c) converting said analog signals to digital signals, (d) cyclically and at relatively long intervals quantifying said digital signals and storing the quantity as a reference in place of the previous quantity, (e) cyclically and at relatively short intervals quantifying said digital signals and comparing the short interval quantity with the reference, (f) actuating an alarm in the event that any difference between the short interval quantity and the reference exceeds a predetermined amount, (g) measuring the ambient temperature to obtain second analog electrical signals corresponding to said temperature, (h) converting said second analog signals into second digital signals, and, (i) applying said second digital signals to said first-mentioned digital signals at short intervals as a compensation for short term thermal effects in the conversion of said light energy to said first-mentioned analog signals.

2. A system for detecting the presence of an aerosol such as smoke in a gaseous medium, comprising (a) a light source adapted to direct a beam of light through said medium, (b) photoresponsive means spaced from and in the path of said beam and adapted to generate analog electrical signals corresponding to the intensity of said beam, (c) analog-to-digital converter means connected to said photoresponsive means and adapted to convert the analog signals therefrom into digital signals, (d) digital processing means including memory means adapted to store reference data therein connected to said converter means for cyclically and at relatively short intervals comparing the output of said converter means with said reference and cyclically and at relatively long intervals measuring the output of said converter means and placing the measurement in said memory as a new reference, (e) alarm means connected to said processing means and adapted to generate an alarm signal in the event that any difference beyond a predetermined amount is detected during a short interval comparison, and, (f) temperature sensing means adapted to generate an analog electrical signal connected to said converter means for obtaining digital signals therefrom corresponding to the output of said temperature sensing means, (g) said digital processing means adapted to process said digital signals from said temperature sensing means with said digital signals from said photo responsive means for adjusting short interval data in said memory means according to predetermined thermal operating characteristics of said light source and said photo responsive means.

3. A system according to claim 2 wherein said converter means includes a hysteresis gate and a capacitor connected to said photoresponsive means.

4. A system according to claim 2 wherein said light source includes a pair of light emitting devices connected in series and adapted to emit a pair of light beans and said photoresponsive means includes a pair of light responsive devices, one each in the path of each beam and said converter means includes a separate analog-to-digital circuit connected to each light responsive device.

5. A system according to claim 2 wherein said light source includes a signal light emitting device and said photoresponsive means includes a pair of light responsive devices, light reflecting means in position to direct one portion of said beam from said light emitting device onto one of said light responsive devices and optical attenuating means between said light emitting device and the other of said light responsive devices and said converter means includes a separate analog-to-digital circuit connected to each light responsive device.

6. A system according to claim 2 including manual control means connected to said processing means for manually recalibrating said system.

7. A system according to claim 2 including ionization means connected to said converter means and adapted to generate an analog electrical signal corresponding to the quantity of smoke in the vicinity of said ionization means, said converter means providing digital signals for said processing means.

8. A system according to claim 5 wherein said analog-to-digital circuits are substantially identical and light control means operatively associated with said system to direct substantially equal amounts of light against each light responsive device.

* * * * *